US005327648A

United States Patent [19]

Ullmann

[11] Patent Number: 5,327,648

[45] Date of Patent: Jul. 12, 1994

[54] ELECTRIC HAIR CUTTING APPARATUS

[75] Inventor: Roland Ullmann, Offenbach, Fed. Rep. of Germany

[73] Assignee: Braun Aktiengesellschaft, Frankfurt, Fed. Rep. of Germany

[21] Appl. No.: 938,241

[22] PCT Filed: Apr. 23, 1991

[86] PCT No.: PCT/DE91/00327

§ 371 Date: Oct. 13, 1992

§ 102(e) Date: Oct. 13, 1992

[87] PCT Pub. No.: WO91/17024

PCT Pub. Date: Nov. 14, 1991

[30] Foreign Application Priority Data

Apr. 27, 1990 [DE] Fed. Rep. of Germany ..... 4013436

[51] Int. Cl.[5] ..... B26B 19/00; B26B 19/20

[52] U.S. Cl. ..... 30/43.1; 30/200

[58] Field of Search ..... 30/43.1, 43.2, 43.3, 30/34.2, 79, 196, 199, 200, 201, 202, 233

[56] References Cited

U.S. PATENT DOCUMENTS

| | | | |
|---|---|---|---|
| 3,264,735 | 8/1966 | Du Churme | 30/202 |
| 3,287,805 | 11/1966 | Du Charme | 30/202 |
| 3,426,428 | 2/1969 | Acciani | 30/202 |
| 4,669,189 | 6/1987 | Ullmann | 30/201 |
| 5,105,541 | 4/1992 | Messinger et al. | 30/200 |

FOREIGN PATENT DOCUMENTS

| | | |
|---|---|---|
| 2517922 | 4/1975 | Fed. Rep. of Germany . |
| 3529516C2 | 8/1985 | Fed. Rep. of Germany . |

*Primary Examiner*—Richard K. Seidel
*Assistant Examiner*—Paul M. Heyrana, Sr.
*Attorney, Agent, or Firm*—Fish & Richardson

[57] ABSTRACT

Described is an electric hair-cutter with a spacer comb (3) fitted on the cutter head and a sliding switch (11) for switching the hair-cutter on and off. The invention calls for the hair-cutter to have a preselector (60) switch which can be set so that the motor is not switched on until the slider switch locks into a predetermined position.

4 Claims, 5 Drawing Sheets

ELECTRIC HAIR CUTTING APPARATUS

This invention relates to an electric hair cutting apparatus, with a shearing head as well as a spacer comb which is adapted to be seated on the shearing head for sliding contact with the skin surface to be treated and is adjustable to various positions with regard to the forward edge of the shearing head, as well as with a sliding switch for enabling and disabling the drive of the hair cutting apparatus, with the spacer comb and the sliding switch being provided with engageable coupling means, and with further positions being provided in addition to the "On" and "Off" positions of the sliding switch.

A hair cutting apparatus of this type is known from U.S. Pat. No. 4,669,189. To turn off the drive, the user is required to return the sliding switch to the "Off" position "O", independent of the length of the cut just made. As a result, also the spacer comb is automatically returned to the position involving the shortest cutting length, so that the user, during the next application, is unable to determine the length of the previous hair cut.

It is therefore an object of the present invention to construct a hair cutting apparatus of the type initially referred to in a manner enabling the user to recognize a cutting length once selected as being appropriate when using the cutter in a subsequent operation.

This object is accomplished in that a preselector slide means is provided which is adjustable such that the drive of the hair cutter is not energized until a predetermined position is set.

Advantageous embodiments will become apparent from the subclaims.

The present invention will be described in more detail in the following with reference to an embodiment illustrated in the accompanying drawings.

The mode of function of the hair cutting apparatus will first be described without the preselector slide means provided.

Figure 1:
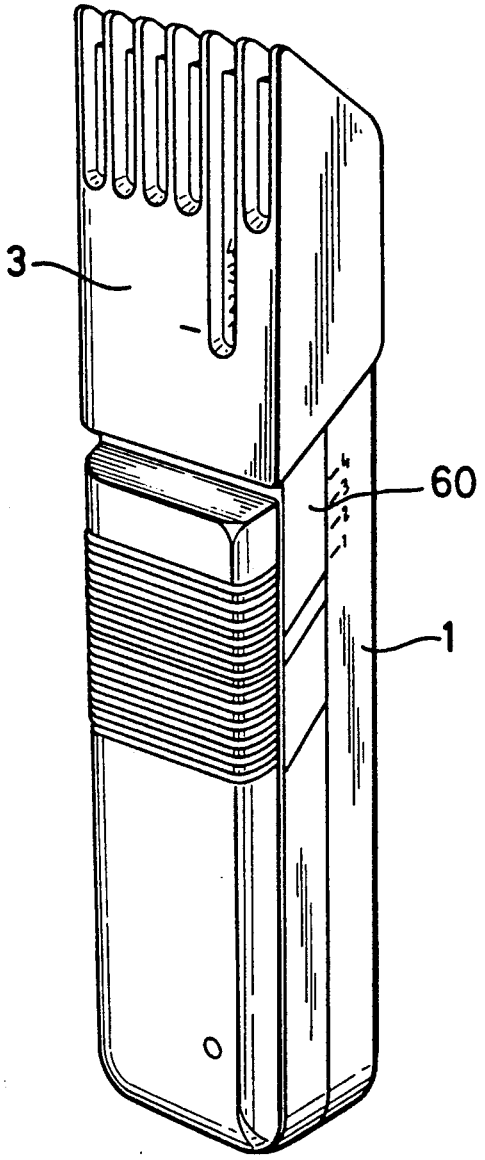
FIG. 1 is a perspective view of a hair cutting apparatus.
Figure 2:
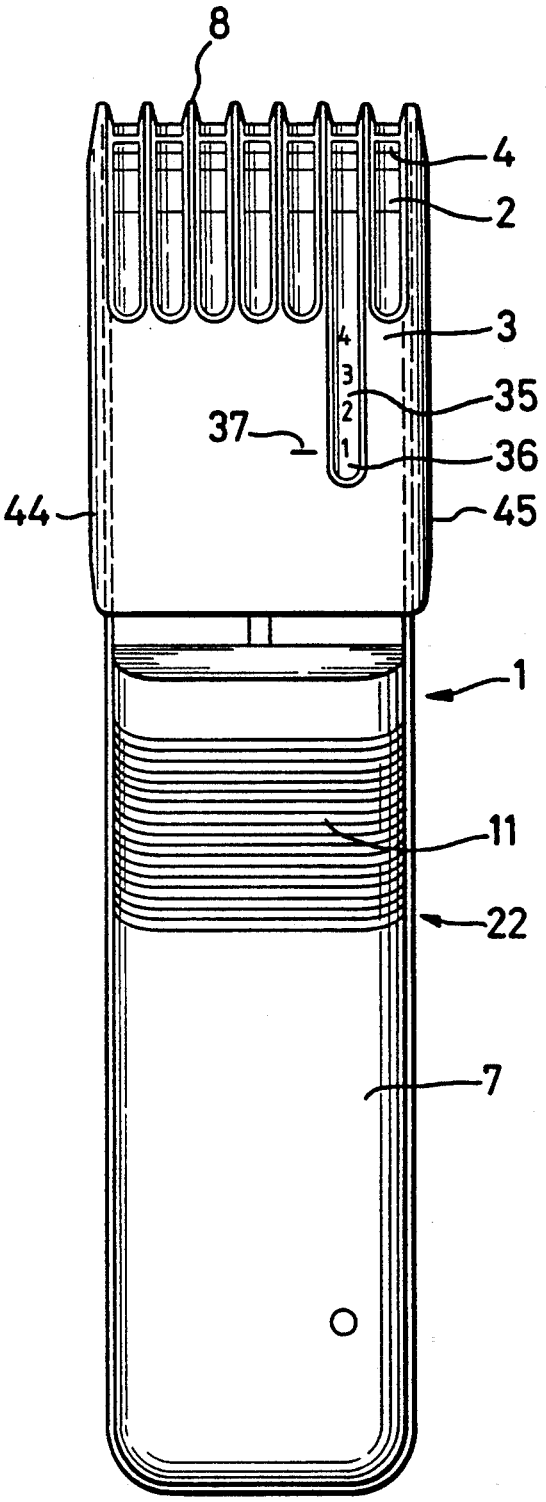
FIG. 2 is a front view of the hair cutting apparatus, showing the spacer comb in its seated position.
Figure 3:
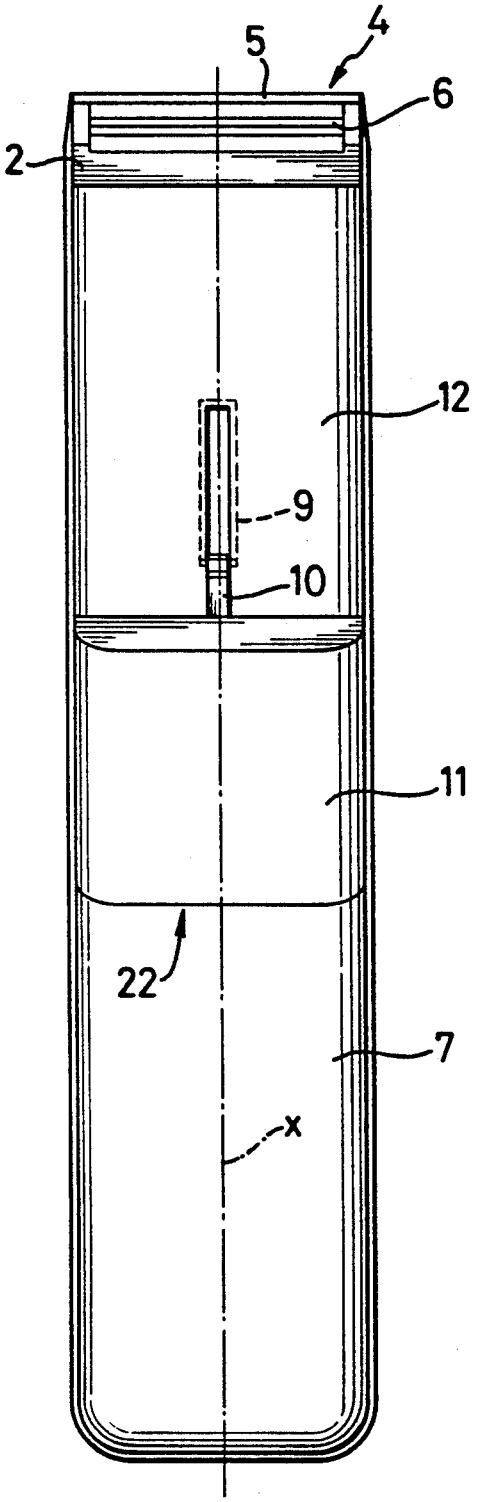
FIG. 3 is also a front view of the hair cutting apparatus, with the spacer comb removed.

As becomes apparent from FIGS. 1 to 4, the hair cutting apparatus 1 comprises substantially a slim, haptical body having a shearing head 2 obstructed in FIGS. 1 and 2 by a spacer comb 3 seated on the shearing head 2. The spacer comb 3 operates to maintain a predetermined distance of the forward edge 4 of the shearing head 2 comprised of a fixed shear plate 5 and a cutting element 6 reciprocating thereon, relative to the skin surface to be treated as, for example, the scalp of a person whose hair is to be cut, with the spacer comb being adjustable to different positions on the shearing head 2 relative to the body 7 of the hair cutting apparatus 1, to be explained later as the description proceeds.

The spacer comb 3, being a hollow body, embraces the body 7 of the hair cutting apparatus 1 in the region of its shearing head 2 on all four sides, with tooth-shaped supports 8 integrally formed on the comb enabling the hair to be cut to extend therebetween up to the shearing head 2, to be eventually cut off by its cutting element 6. The remaining length of the hair after the cut corresponds to the distance between the forward edge of the tooth-shaped supports 8—when in contact with the skin surface—and the forward or cutting edge of the shearing head 2 or its associated cutting element 6, this distance being variable in the present hair cutting apparatus 1, as already mentioned.

For an efficient use of the hair cutting apparatus 1 by means of the spacer comb 3 determining the length of the hair to be cut, the spacer comb includes coupling members cooperating with appropriate coupling members of the body 7 of the hair cutting apparatus.

Figure 4:
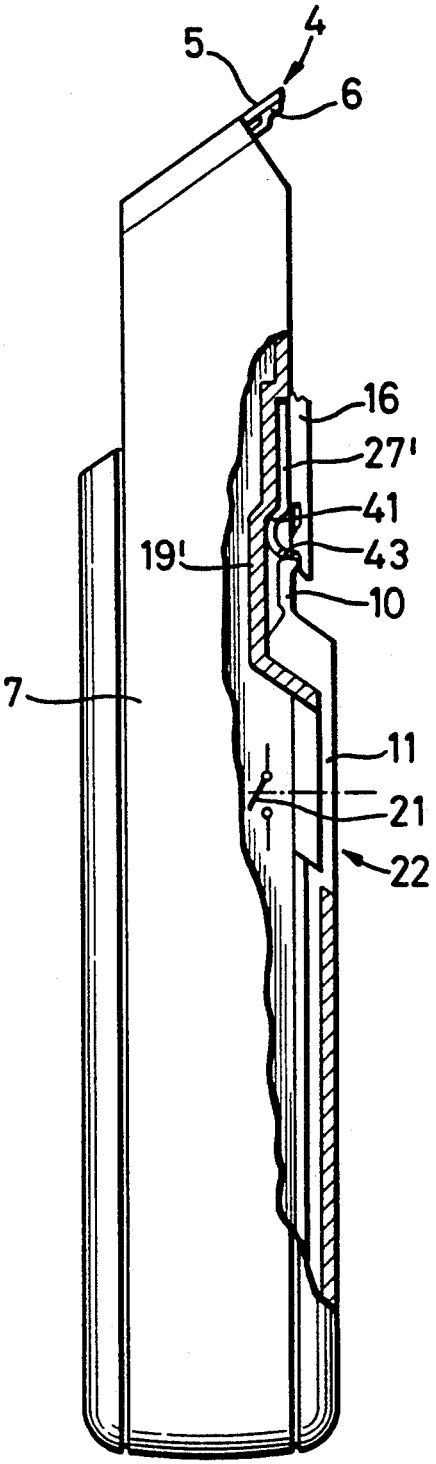
FIG. 4 is a side view of the hair cutting apparatus of FIG. 3, shown partially in longitudinal section.
Figure 5:
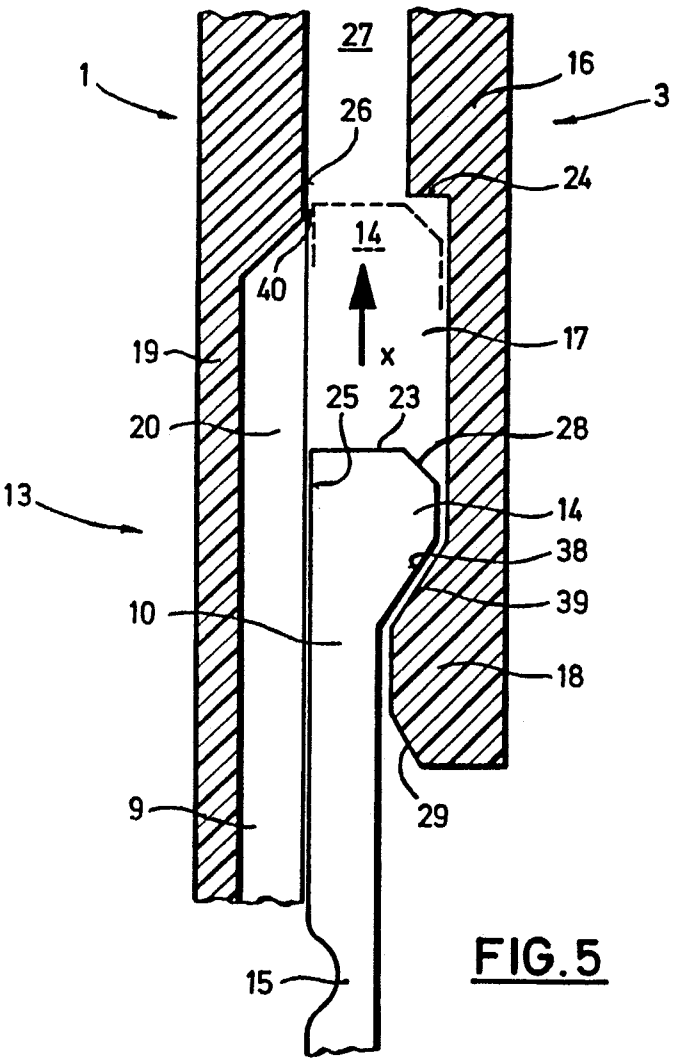
FIG. 5 is a schematic of the basic coupling structure between the hair cutting apparatus and the spacer comb seated on its shearing head.

As shown particularly in FIGS. 4 and 5, the hair cutting apparatus 1 has for this purpose a coupling rod 10 which is slidable in the direction of the longitudinal axis x of the hair cutting apparatus 1 in a guideway 9 of T-shaped cross section provided in the casing. The coupling rod 10 is operatively connected with a sliding switch 11 extending over the entire width of the hair cutting apparatus 1, thereby permitting a safe operation of the device by the user's left or right hand, that is, a one-hand operation. The sliding switch 11 fulfills several functions, first it serves to enable or disable the electrical or mechanical drive of the hair cutting apparatus 1, second it provides for engagement or disengagement of the spacer comb 3 with or from the hair cutting apparatus 1 according to the requirements of its use, and finally it operates to adjust the coupled spacer comb 3 to its individual positions of use resulting in different distances.

FIGS. 5 to 10 show, in various phases of coupling engagement, the function of the coupling rod 10 slidable in longitudinal direction by means of the sliding switch 11 within and below the front wall 12 of the hair cutting apparatus 1 as it cooperates with the coupling means of the spacer comb 3.

In this arrangement, FIG. 5 shows the basic mode of operation of the coupling 13 between the sliding switch 11 of the hair cutting apparatus 1, which sliding switch is operatively connected with the coupling rod 10, and the spacer comb 3 adapted to be seated on the shearing head 2 of the body 7 of the hair cutting apparatus 1.

As shown, the coupling rod 10 operatively connected with the sliding switch 11 includes an integrally formed coupling nose 14 which is pivotal about the axis of a film hinge 15 formed integral with the coupling rod 10, such that the coupling nose 14, following each pivot movement, automatically returns to its initial position shown in FIG. 5.

In the region of its wall 16 serving as a coupling means, the spacer comb 3 which embraces the shearing head 2 of the hair cutting apparatus 1 when seated thereon includes a coupling groove 17 receiving the coupling rod 10 together with its coupling nose 14. The coupling groove 17 comprises a detent shoulder 18 which is formed integral with the coupling wall 16 of the spacer comb 3 and is overcome by the coupling nose 14 of the coupling rod 10 by withdrawing into a recess 20 formed in the region of the coupling groove 17 by a casing wall 19 of the hair cutting apparatus 1 during seating engagement of the spacer comb 3.

The seated spacer comb 3 is then retained by the coupling nose 14 of the coupling rod 10 engaging the detent shoulder 18 of the comb, being thereby secured from inadvertent disengagement from the hair cutting apparatus. In this seated position of the coupling members 10, 14 of the hair cutting apparatus 1 and the coupling members 17, 18 of the spacer comb 3 thus brought into relative engagement, the sliding switch 11 which also operates on electric switches 21 for the drive is still in its "Off" position in which the supply circuit of the hair cutting apparatus 1 is open. By subsequently shifting the sliding switch 11 and consequently also the coupling rod 10 into the direction of the axis x of the hair cutting apparatus 1—which corresponds to the direction of movement x of the spacer comb 3—from the "Off" position shown in FIG. 5 to the "On" position shown in dotted lines, the sliding switch 11 will actuate the switch, thereby closing the supply circuit of the hair cutting apparatus 1 and thus enabling its drive not shown.

In this "On" position, the end wall 23 of the coupling rod 10 abuts a stop shoulder 24 integrally formed on the coupling wall 16 of the spacer comb 3, while the side wall 25 on the side remote from the coupling nose 14 (according to FIG. 5) becomes slidably engaged by the inner wall 26 of a force guide 27 formed by the casing wall 19 of the hair cutting apparatus 1 and the coupling wall 16 of the spacer comb 3. In the "On" position of the sliding switch 11, the force guide 27 thus prevents the coupling rod 10 from yielding to the stop shoulder 24. Accordingly, the beveled edge 28 of the coupling rod 10 which, as the spacer comb 3 is being seated, cooperates with the beveled edge 29 of the detent shoulder 18 of the coupling wall 16 of the comb to facilitate yielding, has no effect in this position.

Figure 6:
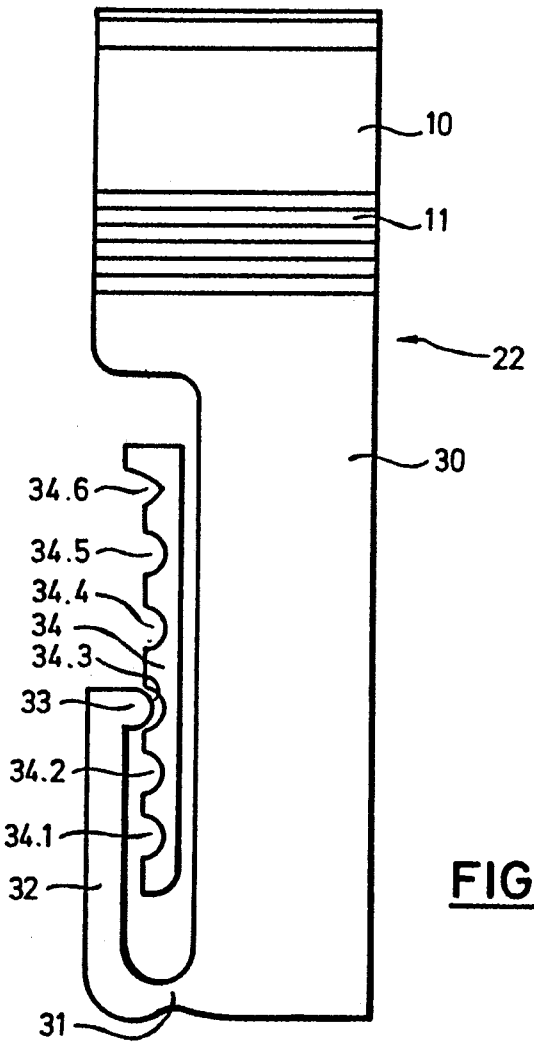
FIG. 6 is a view of the ratchet gear of the hair cutting apparatus of the invention for positioning the spacer comb at different relative distances to the forward edge of the shearing head.

FIG. 6 is a schematic front view of a vertically slidable grip member 30 comprising both the coupling rod 10 and the sliding switch 11 and serving as the central switch means of the hair cutting apparatus 1. Provided on the grip member 30 in this FIG. is a detent pawl 32 which is pivotal about an integrally formed film hinge 31 and has a tongue 33 which, due to its inherent resilience, engages into respective notches of a ratchet bar 34 formed fast with the casing of the hair cutting apparatus 1 to thereby provide a respective ratchet gear. The "Off" position of the sliding switch 11 is determined by engagement of the tongue 33 into the lowermost notch 34.1 (according to FIG. 6). If the sliding switch 11 is pushed upwards by one index position, the tongue 33 will engage the notch 34.2 which determines the "On" position of the sliding switch 11. The coupling rod 10, in leaving its "Off" position it has assumed after overcoming the detent shoulder 18, will thus assume the "On" position in which its coupling nose 14 abuts the stop shoulder 24 and the inner wall 26 of the force guide 27, thereby performing the coupling engagement of the hair cutting apparatus 1 with the spacer comb 3 for the purpose of positioning the spacer comb.

Pushing the sliding switch 11 in the direction x (FIG. 5) by another index position causes the tongue 33 to fall into the notch 34.3. As a result of the abutting engagement of its end wall 23 with the stop shoulder 24 of the coupling wall 16, the coupling rod 10 which is made to follow this movement in the direction x causes the spacer comb 3 to be shifted into a first position. In this first position, a relatively short length of the hair extending through the spacer comb 3 is cut. In this embodiment, the positions are indicated by a graduated scale 35 provided on the shearing head 2 of the hair cutting apparatus 1 and showing the digits "1" to "4" in a window 36 arranged between and below two adjacent tooth-shaped supports 8 of the spacer comb 3. A mark 37 provided on the front side of the spacer comb 3 indicates the respective position of the spacer comb 3—in the FIG. shown, the minimum possible position "1".

Similarly, a further upward shifting motion of the coupling rod 10 by means of the sliding switch 11 it is operatively connected with moves the spacer comb 3 into further positions increasing the distance between the shearing head 2 and the spacer comb 3, these positions being identified by the tongue 33 falling into respective notches 34.4, 34.5 and 34.6 and being indicated on the graduated scale 35 by the mark 37 corresponding with respective scale digits "1", "2", "3" or "4" or by reading the lowermost scale digit not obstructed by the spacer comb 3, when viewed in the shifting direction.

Retracting the spacer comb 3—for example, to adjust the hair cutting apparatus to a shorter length of the cut—is accomplished simply by pushing the sliding switch 11 back in opposition to the direction of the arrow x. This involves movement of the coupling rod 10 in the same direction, and the action of the force guide 27 will cause the coupling wall 16 of the spacer comb 3 to be entrained as a result of the abutting engagement of the beveled edge 38 of the rod with the corresponding beveled edge 39 of the coupling wall 16, until the position "1" is reached in which the length of the cut is at a minimum and which is identified by the tongue 33 falling into the notch 34.3. As the coupling rod 10 continues to be pushed back in opposition to the direction of the arrow x by means of the sliding switch 11, the coupling nose 14 of the coupling rod 10, after having overcome the stop edge 40 which in FIG. 5 extends slightly below the plane of the stop shoulder 24 formed by the coupling wall 16, thus protruding relative to the latter by a small amount in the coupling direction x, reaches the area of the coupling groove 17 in which the coupling nose 14 of the coupling rod 10, abutting the detent shoulder 18 of the comb, is allowed to withdraw into the recess 20.

Accordingly, on further backward movement of the coupling rod 10 by means of the sliding switch 11, the coupling nose 14 will overcome the detent shoulder 18 by the coupling rod 10 pivoting counterclockwise about the film hinge 15, thereby releasing the spacer comb 3 for removal by hand. The sliding switch 11 of the hair cutting apparatus thereby assumes the "On" position identified by the engagement of the tongue 33 into the notch 34.2, in which position the hair cutting apparatus 1 is still on. Shifting the sliding switch 11 back still further until its detent pawl 32 drops into the notch 34.1 finally turns off the entire drive of the hair cutting apparatus 1 by means of the electric switch 21 controlled or actuated by the sliding switch 11.

Figure 7:
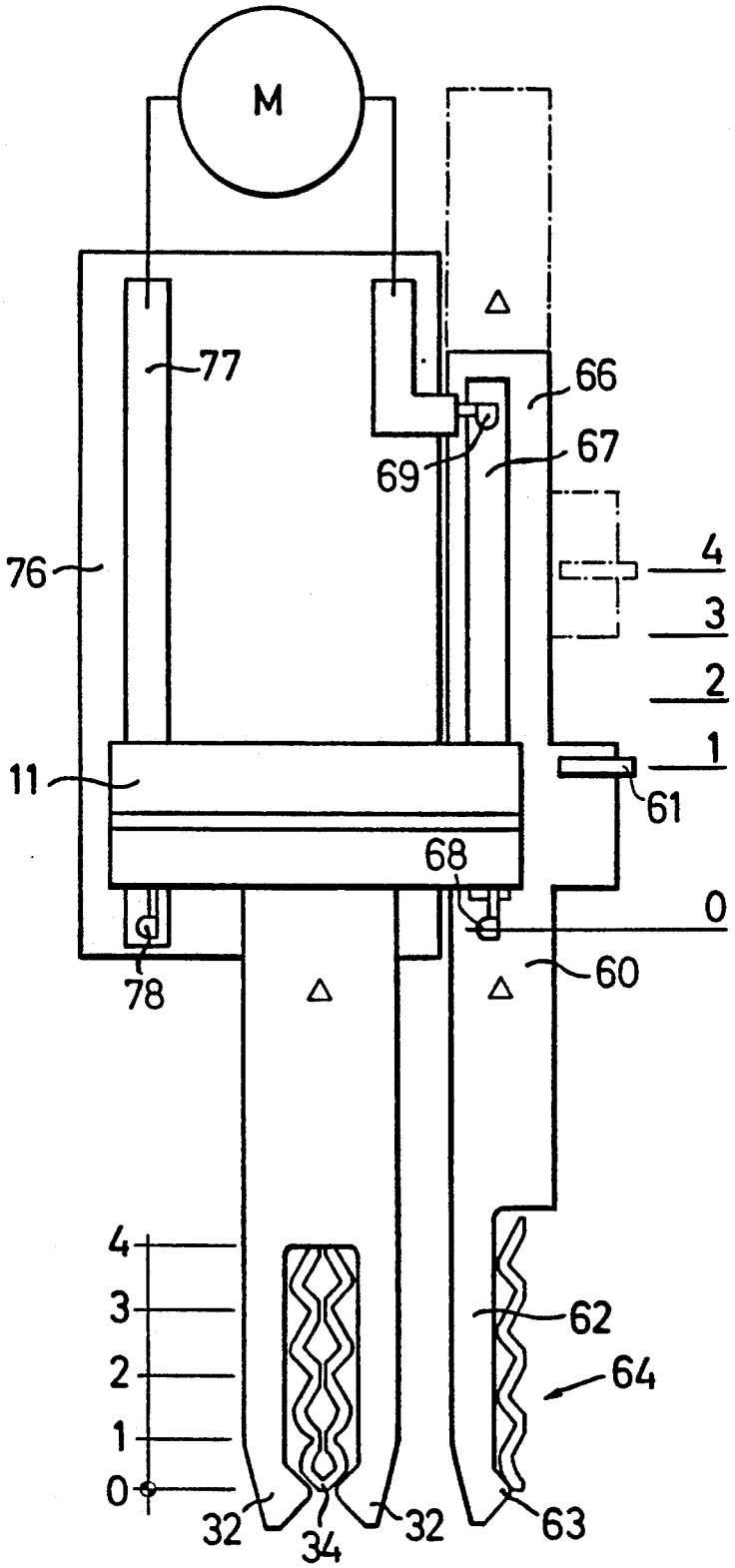
FIG. 7 is a schematic of an embodiment.
Figure 8:
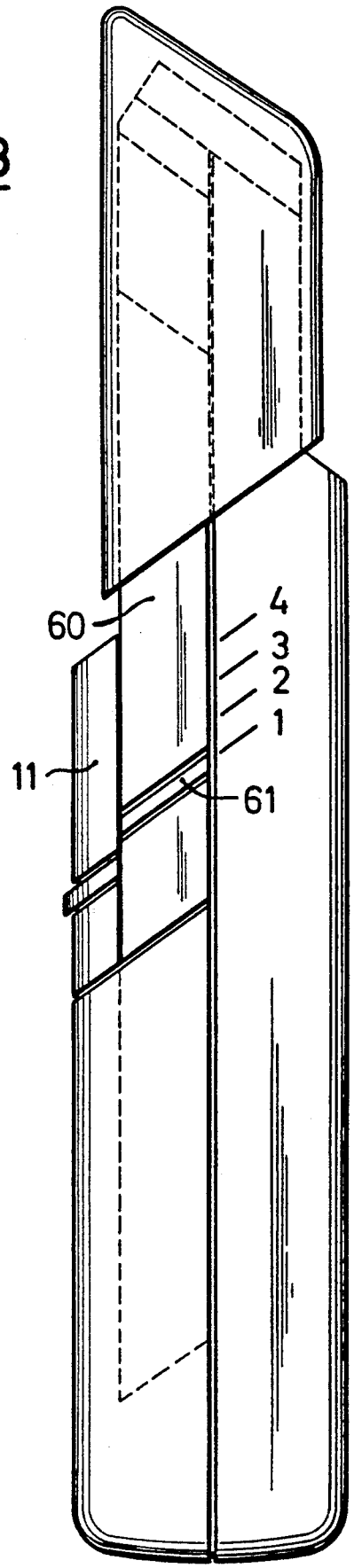
FIG. 8 is a side view of a hair cutting apparatus equipped with a preselector slide means.

The schematic illustrated in FIG. 7 shows a preselector slide means 60 movable in longitudinal direction, comprising a printed circuit board 66, a detent pawl 62 and a handhold 61. The handhold 61 enables the preselector slide means 60 to be moved to various positions 1, 2, 3 and 4. These positions are determined by a ratchet bar 64 fixed in position in the casing, the ratchet bar having notches for locking engagement with the tongue 63 provided at the end of the detent pawl 62.

The relative distances of the positions of the preselector slide means 60 correspond to the relative distances of the positions 1, 2, 3 and 4 of the sliding switch 11. The positions of the sliding switch 11 are determined by detent pawls 32 secured thereto whose ends are adapted for locking engagement in notches of ratchet bars 34 equally fixed in position in the casing.

The sliding switch 11 is provided with two sliding contacts 68 and 78 whereof the one sliding contact 78 slides over the conductor 77 of a printed circuit board 76 fixedly mounted in the casing, while the other sliding contact 68 slides over the conductor 67 of the printed circuit board 66 of the preselector slide means 60. The two sliding contacts 68 and 78 are in connection with each other in the sliding switch 11. The upper end of the conductor 77 is fixedly connected to the motor M, while the upper end of the conductor 67 is connected through a sliding contact 69. Since the conductor 77 of the fixedly mounted printed circuit board 76 is connected to a terminal of the voltage source, the motor M will be turned on when the sliding switch 11 interconnects the two conductors 77 and 67 through the sliding contacts 78 and 68.

In the position shown in FIG. 1, the sliding switch 11 is in the position "0", that is, the motor is turned off, and the preselector slide means 60 is in the position "1" corresponding to the shortest adjustable cutting length. On shifting the sliding switch from the position "0" up to the position "1", the motor will be turned on, because the sliding contact 68 is then connected to the conductor 67.

If the preselector slide means 60 was set to position "4" (shown in dot-and-dash lines) which corresponds to the maximum adjustable cutting length, the sliding contact 68 would not contact the conductor 67, that is, it would not energize the motor, until the sliding switch 11 was equally pushed up into position "4".

In this manner it is ensured that the hair cutting apparatus does not start operation until the sliding switch (in conjunction with the spacer comb seated thereon) has reached the position marked with the preselector slide means. This solution has the advantage of preventing the hair from being accidentally clipped to a length shorter than preselected. Further, with the preselector slide means 60 in position "1", the hair cutter functions as it did before with all adjusted hair lengths.

In another solution, the conductor 67 on the printed circuit board 66 may be of such a short length that the sliding contact 68 contacts the conductor in only a single position of the preselector slide means 60, as a result of which the hair cutter starts operating only in this single preselected position.

I claim:

1. Hair cutting apparatus comprising casing structure, drive structure in said casing structure, circuitry connected to said drive structure, shearing head structure coupled to said drive structure, said shearing head structure having a forward edge, spaced comb structure adapted to be seated on said shearing head structure for sliding contact with the skin surface to be treated and adjustable relative to said forward edge of said shearing head structure, sliding switch structure coupled to said circuitry for enabling and disabling said drive structure and having "On" "Off" positions and further positions in addition to said "On" and "Off" positions, said spacer comb structure and said sliding switch structure being provided with engageable coupling means for causing said spacer comb structure to move with said sliding switch structure, adjustable preselector slide structure movable between a plurality of positions, and cooperating contact structure on said preselector slide structure and said sliding switch structure and connected to said circuitry such that said drive structure is not energized until said sliding switch structure is in a predetermined position as determined by the position of said preselector slide structure.

2. The hair cutting apparatus of claim 1 and further including ratchet bar structure fixedly mounted in said casing structure, and wherein said circuitry includes a fixed conductor fixedly mounted in said casing structure, said preselector slide structure includes a printed circuit board having a slide conductor arranged thereon and a detent pawl adapted to engage said fixedly mounted ratchet bar, said preselector slide structure being movable in the longitudinal direction of said fixed conductor such that, depending on the preselected position of said preselector slide structure, said sliding switch structure will not close said circuitry for said drive structure through said fixed conductor and said slide conductor until said sliding switch structure has reached the position corresponding to the predetermined position of said preselector slide structure.

3. The hair cutting apparatus of claim 2 wherein the length of said slide conductor on said preselector slide structure is such that said drive circuitry is closed when said sliding switch structure is in said preselected position provided by said preselector slide structure and for all subsequent positions corresponding to longer lengths of hair.

4. The hair cutting apparatus of claim 2 wherein the length of said slide conductor on said preselector slide structure is such that said drive circuitry is closed only when said sliding switch structure is in said preselected position provided by said preselector slide structure.

* * * * *

UNITED STATES PATENT AND TRADEMARK OFFICE

CERTIFICATE OF CORRECTION

PATENT NO. : 5,327,648

DATED : July 12, 1994

INVENTOR(S) : Roland Ullmann

It is certified that error appears in the above-indentified patent and that said Letters Patent is hereby corrected as shown below:

Column 1, line 28, replace "a" with --an--.
insert --adjustable-- before "preselector".
Column 1, line 29, delete "adjustable" and insert --coupled to the sliding switch by further means--.
Column 2, line 40, delete "to 10" and insert --and 6--.

Signed and Sealed this

Fifteenth Day of November, 1994

*Attest:*

*Attesting Officer*

BRUCE LEHMAN

*Commissioner of Patents and Trademarks*